United States Patent [19]

Komatsu

[11] 4,114,125

[45] Sep. 12, 1978

[54] PLUNGER TYPE SOLENOID

[75] Inventor: Saburo Komatsu, Odawara, Japan

[73] Assignee: O.P.O. Giken Kabushiki Kaisha, Japan

[21] Appl. No.: 715,193

[22] Filed: Aug. 17, 1976

[30] Foreign Application Priority Data

| | | | |
|---|---|---|---|
| Aug. 18, 1975 | [JP] | Japan | 50-099961 |
| Nov. 29, 1975 | [JP] | Japan | 50-142639 |
| Dec. 8, 1975 | [JP] | Japan | 50-146119 |

[51] Int. Cl.[2] ..... H01F 7/08

[52] U.S. Cl. ..... 335/258; 251/54; 188/282; 188/317

[58] Field of Search ..... 335/255, 257, 258, 260, 335/262; 251/54; 188/282, 288, 298, 314, 317, 319

[56] References Cited

U.S. PATENT DOCUMENTS

| | | | |
|---|---|---|---|
| 1,137,123 | 4/1927 | Fernazo | 188/288 |
| 1,214,719 | 2/1917 | Slattery | 188/288 |
| 1,543,098 | 6/1923 | Carter et al. | 188/282 |
| 1,995,721 | 3/1935 | Sanford | 188/298 |
| 3,226,605 | 12/1965 | Wright et al. | 335/257 X |
| 3,850,276 | 11/1974 | Patel | 188/298 X |

*Primary Examiner*—George Harris

*Attorney, Agent, or Firm*—Wenderoth, Lind & Ponack

[57] ABSTRACT

An improved plunger type solenoid comprises a solenoid coil, a plunger to be attracted into the solenoid coil, a piston directly or indirectly connected to the plunger and a cylinder filled with oil for containing the piston. The piston is subject to the pressure of the oil, such that the speed of movement of the plunger is widely controlled.

11 Claims, 8 Drawing Figures

PLUNGER TYPE SOLENOID

BACKGROUND OF THE INVENTION

1. Field of the Invention

The present invention relates to plunger type solenoids and more particularly to solenoids having plungers the speed of movement of which is easily controlled.

2. Description of the Prior Art

Plunger type solenoids are widely employed for various uses, for instance, as an automatic control device, a remote handling system, an automatic numerical control (NC) device or a data processing apparatus. A feature of the plunger type solemoids is that they may be operated with a high degree of reliability. However, the speed of the plungers is practically difficult to control because the mechanical output thereof is small compared to their high speed. In drive systems for various control devices, the speed of operation must be controlled. Accordingly, the plunger type solemoids must be provided with speed controllers when used in control devices.

In plunger type solemoids, an efficient speed control is very difficult to achieve if an energy loss occurs, because the mechanical output of the solenoid is small, as set forth above. Therefore, friction resistance must be reduced to an extreme extent to provide satisfactory speed control.

Further, the inventor has discovered that the speed of the plunger increases suddenly as the stroke of the plunger approaches the zero or end position. In general, the speed of the plunger is proportional to the attractive force of the coil thereon, so that the chracteristic speed build-up of the plunger must be linear, to avoid wear and to lengthen the life of the apparatus to which the solenoid is attached.

Accordingly, it is an object of the present invention to provide plunger type solenoids having plungers the speed of which are easily controlled with high reliability.

It is another object of the present invention to provide plunger type solenoids in which friction resistance is eliminated during operation, to thereby provide an excellent durability.

It is a further object of the present invention to provide plunger type solenoids which are provided with an adjusting device to provide a fine speed control.

It is a still further object of the present invention to provide plunger type solenoids, the speed characteristic of which is linear.

SUMMARY OF THE PRESENT INVENTION

According to the present invention, the improved plunger type solenoid includes a solenoid coil, a plunger to be attracted by and into the solenoid coil, a piston connected through a shaft to the plunger, and a cylinder filled with a liquid for containing the piston, wherein the speed of movement of the piston within the cylinder is controlled, to thereby control the speed of the plunger.

According to another feature of the present invention, the improved plunger type solenoid includes a drive mechanism including a solenoid coil and a plunger, an oil pressure mechanism including a cylinder filled with a liquid and a piston contained therein, and a device for adjusting the amount of flow of the liquid, such device being composed of a by-pass both ends of which are connected respectively to the cylinder at opposite sides of the piston, and of a device for adjusting the amount of flow through the by-pass.

According to a further feature of the present invention, the improved plynger type solenoid includes a solenoid coil, a plunger to be attracted by and into the solenoid coil, a piston connected to the plunger, a cylinder filled with a liquid for and containing the piston such that the speed of the piston is controlled in the cylinder to provide a control of the attractive force of the plunger, and means for absorbing the attractive force which increases as the stroke of the plunger approaches zero.

BRIEF DESCRIPTION OF THE DRAWINGS

The present invention will be more fully understood by reference to the following detailed description thereof, when read in conjunction with the attached drawings, wherein like reference numerals refer to like parts throughout the drawings, and in which.

DETAILED DESCRIPTION OF THE PREFERRED EMBODIMENTS

Figure 1:
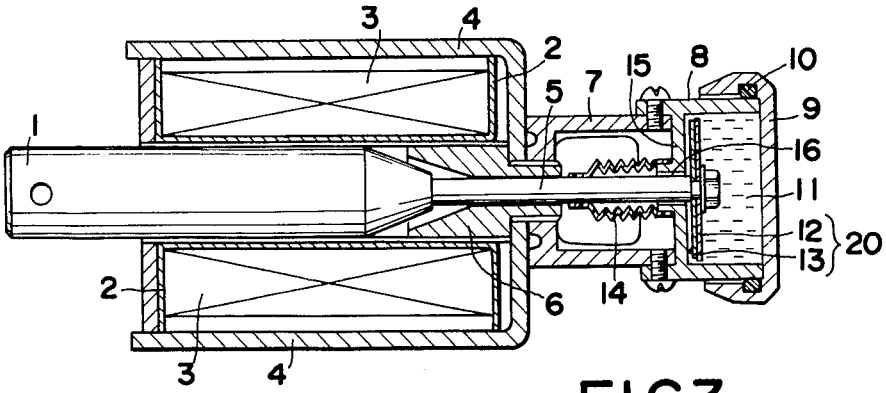
FIG. 1 is a cross sectional view showing an embodiment of a plunger type solenoid according to the present invention.

With reference to FIG. 1, there is shown an embodiment of a plunger type solenoid according to the present invention. A plunger 1 is inserted into a hollow portion of a solenoid coil 3 wound over a bobbin 2. The solenoid coil 3 is covered with a frame 4 and the plunger 1 is connected to one end of a shaft 5 the other end of which is connected to a piston 20 composed of elements 12 and 13. The plunger 1 is adapted to advance up to the position where a receiving member 6 is positioned thereby to provide a contact therebetween by the energization of the solenoid coil 3. The piston 20 may be submerged in a fluid, preferably in oil 11 filling a cylinder 8. There is provided a small gap 16 to allow the oil 11 to pass therethrough between a cylinder wall 15 and the shaft 5. The cylinder 8 is covered with a lid 9 and an O ring 10 is provided to form an air and water tight seal therebetween. On the other hand, an expansion member 14 is positioned over the shaft 5 to sealingly close the flowing gap 16. A spacer 7 surrounds the expansion member 14 between the frame 4 and the cylinder 8.

Figure 2:
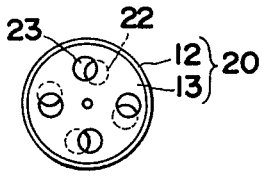
FIG. 2 is an explanatory view showing a piston for use in the embodiment of FIG. 1.

With reference next to FIG. 2, there is shown a piston 20 consisting of elements 12 and 13. The element 12, which is made of rubber or plastic materials having an oil-proof nature, is slightly larger in diameter than the element 13, which is made of metal, while the concentrically combined elements 12 and 13 are both slightly smaller in diameter than the cylinder 8 to provide an oil flowing gap therebetween. The non-metal disc element 12 and the metal disc element 13 have therethrough apertures 22 and 23, respectively for adjusting the oil 11 flowing therethrough so that the amount of oil passing through the apertures 22 and 23 varies depending upon the positions of the elements in relation to each other.

Figure 3:
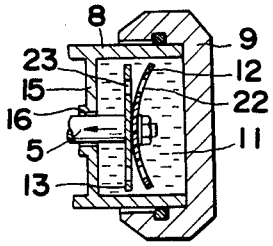
FIG. 3 is a cross sectional view showing an operation for returning the piston shown in FIGS. 1 and 2.

In operation of the plunger type solenoid as shown in FIGS. 1 to 3, the plunger 1 is attracted into the solenoid coil 3 when the coil is energized by application of a predetermined voltage thereto so that the piston 20 is forced by the motion of the shaft 5 to move to the right as shown in FIG. 1. In this case, the speed of the piston is moderated because the cylinder 8 is filled with the oil 11. This causes the oil 11 to leak through the gap 16, however, the leaked oil is absorbed by the bellows like expansion member 14 so that no oil flows out of the described assembly. The speed of the piston 20, that is the speed of the plunger 1, is easily selected depending upon the outer diameter of the piston 20, the viscosity of the oil, the diameter of the adjusting apertures 22 and 23 or the combined relation between the elements 12 and 13.

The piston 20 can also move toward the right in FIG. 1 because the oil 11 will easily pass through the gap between the piston 20 and the cylinder 8 and through the adjusting apertures 22 and 23. The shape of the piston 20, however, is deformed as shown in FIG. 3, during return movement from the right side of the cylinder 8. That is, the plunger 1 begins moving toward the left by the pulling force caused by means (not shown) when the solenoid coil 3 is deenergized. The oil-proof rubber disc element 12 is forced to deform due to its softness during this returning motion so that the return movement of the piston 20 is made easier, since the resistance of the piston to passage through the oil is decreased by the enlargement of the passages for the oil 11 formed by the gap around the piston and by the enlarged adjusting apertures 22 and 23.

Figure 4:
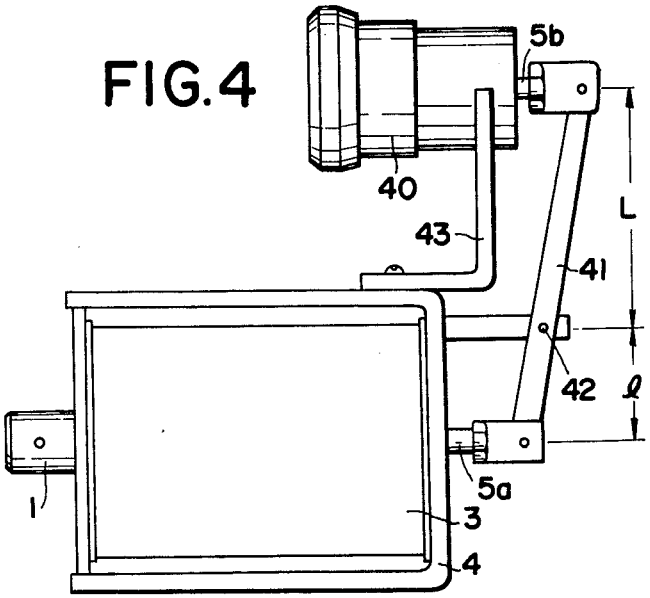
FIG. 4 is an explanatory view showing another embodiment of a plunger type solenoid according to the present invention.

In FIG. 4, there is shown another embodiment of a plunger type solenoid according to the present invention. The difference from the first embodiment of the present invention is that a shaft **5*a* directly connected to a plunger 1 is connected through a lever 41 to a shaft 5*b* directly connected to a piston (not shown). It is necessary to transform the output of a solenoid coil 3 to convey it to the piston, such that the stroke of the piston is relatively large when the stroke of the plunger is relatively short. For this reason, there is provided a transformation device formed by the lever 41 pivotable at a supporting point 42. The full length of the lever 41 is divided by pivot 42** into lengths at a ratio of L to *l*, so that the output movement of the plunger 1 is transformed from the shaft **5*a* to the shaft 5*b* at the ratio of 1 to L. The piston is directly connected to the shaft 5*b* and is contained in an oil filled cylinder of a speed control device 40 fixed to a frame 4 by an L-shaped member 43**.

Figure 5:
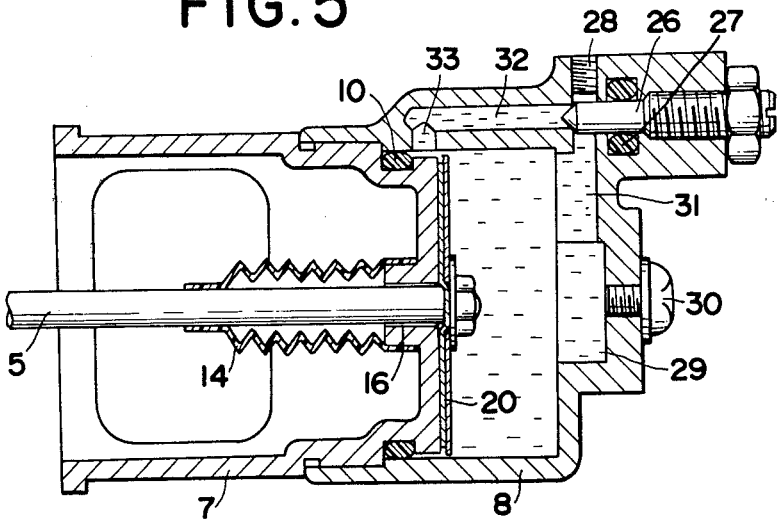
FIG. 5 is a cross sectional view showing a further embodiment of a plunger type solenoid according to the present invention.

In FIG. 5, there is shown a further embodiment of a plunger type solenoid according to the present invention. FIG. 5 shows only an enlarged oil pressure mechanism including passages 31, 32 and 33 forming a by-pass around cylinder 8 from both ends thereof. A piston 20 is attached to the end of a shaft 5 and is contained in the cylinder 8 filled with oil. The piston 20 is composed of two elements as shown in FIGS. 1 to 3. An expansion member 14 and a spacer 7 are provided coaxially of the shaft 5 and an oil gap 16 is provided to absorb rapid changes of oil pressure. An O ring 10 is positioned at one end of the cylinder 8 to air and water tightly seal the cylinder 8. A concave portion is formed at the other end of the cylinder 8 to provide an auxiliary cylinder 29, so that the general characteristic that the speed of the plunger 1 increases as the stroke thereof approaches zero is eliminated. A bolt 30 for closing an oil filling aperture is provided at a portion of the auxiliary cylinder 29.

As set forth above, the by-pass composed of the passages 31, 32 and 33 allows the oil to circulate from the front surface portion of the piston 20 to the back surface portion thereof as the piston 20 moves toward the right under the attractive operation of the solenoid. There is provided a bolt 26, for adjusting the amount of the oil flow through the by-pass, positioned between the passages 31 and 32 so that the amount of oil circulating is easily adjustable by changing the protruding degree of the bolt 26 into the by-pass. The bolt 26 is surrounded by an O ring 27 to maintain an air and water tight seal therearound. For purposes of ease of manufacture, a blind bore is formed in the housing of cylinder 8, but is closed by a stopper 28.

Figure 6:
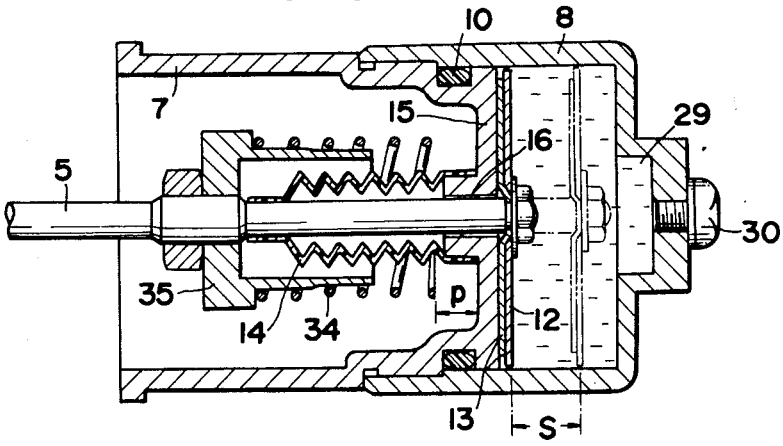
FIG. 6 is a cross sectional view showing a still further embodiment of a plunger type solenoid according to the present invention.

With reference to FIG. 6, there is shown a still further embodiment of a plunger type solenoid according to the present invention. Although portions of the solenoid and a plunger are not shown, a shaft connected directly or indirectly though a transformation device to the plunger is shown to be connected to a piston composed of two elements 12 and 13 contained in a cylinder. The shaft 5 is surrounded by a spring 34 received on a spring guide 35. An oil gap 16 is formed between the shaft 5 and a cylinder wall 15 to communicate a chamber formed by an expansion member 14 therethrough with the oil in the cylinder 8. The cylinder is provided with an auxiliary cylinder 29, an oil supplying aperture of which is closed by a bolt 30.

In a given design, a distance P between the cylinder wall 15 and the spring 34 was selected at 4 mm and an attractive distance (stroke) of the plunger 1, that is the stroke S of the piston, was selected at 6 mm.

Figure 7:
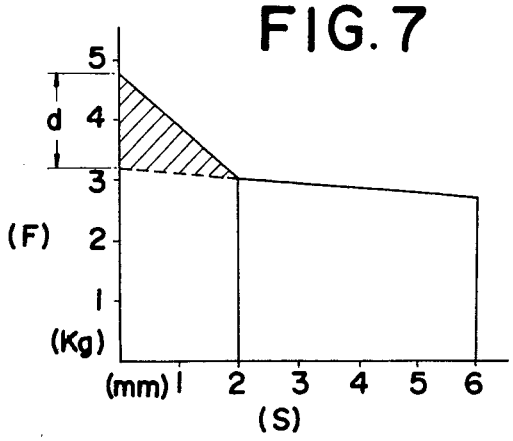
FIG. 7 is a graphical representation showing the relation between the attractive force and stroke during the operation of a plunger.

With reference to FIG. 7, there will be explained the plunger type solenoid according to the present invention which has the above mentioned designed values. In FIG. 6, the position of the piston indicated by the dotted lines (imaginary lines) is that whereat the motion of the piston was complete after the plunger 1 was attracted, and the distance S between the solid line piston position and the dotted line piston position is referred to as the "stroke". In this disclosure, S is 6mm at the solid line piston position and S is 0 at the dotted line piston position. The piston continues moving against the oil pressure acting thereagainst after the top portion of the spring 34 contacts with the cylinder wall 15 when the plunger 1 is attracted by an application of control current to the solenoid coil 3 shown in FIG. 1, because the distance P between the spring 34 and the cylinder wall 15 is selected at 4mm as set forth above. The attractive force F slightly increases linearly while the stroke S varies from 6 to 2 during this motion of 4mm. However, the attractive force F for the plunger 1, that is, the attractive speed increases suddenly while the stroke S ranges from 20 to 0 as shown by the top solid-line curve in FIG. 7. The plunger type solenoid shown in FIG. 6 is designed to absorb such suddenly increasing attractive force and to provide a continuance of the previous linear characteristic, whereby the attractive force F decreases down to the dotted-line curve shown in FIG. 7, thus eliminating the hatched portion in FIG. 7, by the operation of the spring 34. The decrease in force is expressed as "d" when S is 0. That is, the spring 34 begins touching the cylinder wall when the of movement distance of the plunger 1 is 4mm, and spring 34 is then compresses by 2mm when S reaches 0. The suddenly increasing attractive force F is absorbed as shown in FIG. 7 by the compression of the spring 34. A plate spring may be used in place of the coiled spring shown in the above embodiment.

Figure 8:
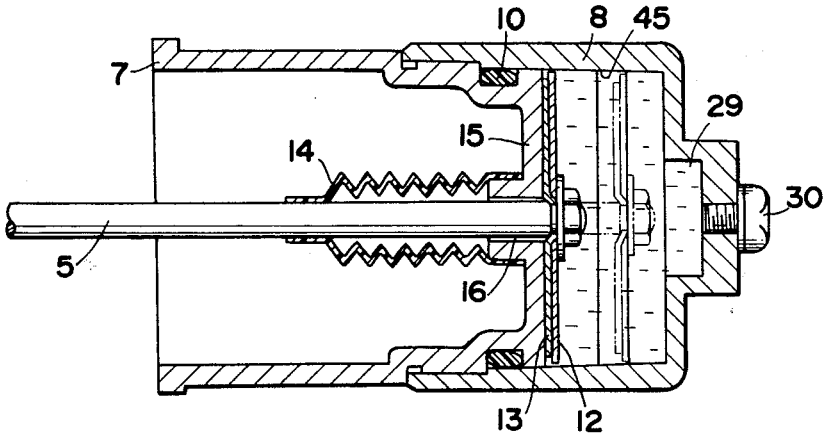
FIG. 8 is a cross sectional view showing an even further embodiment of a plunger type solenoid according to the present invention.

In FIG. 8, there is shown an even further embodiment of a plunger type solenoid according to the present invention. The plunger, the bobbin and the solenoid coil, etc., are not shown as in FIGS. 5 and 6. A shaft 5 directly or indirectly connected to the plunger 1 is connected to a piston composed of elements 12 and 13 positioned in a cylinder 8. The cylinder 8 is provided with a control portion 45 having a tapered configuration to absorb the suddenly increasing attractive force. The cylinder 8 is also provided with an auxiliary cylinder 29, an oil supplying aperture of which is closed by a bolt 30. There are also provided an O-ring 10, an oil gap 16 between the shaft and a cylinder wall and an expansion member 14 over the shaft 5 as in the preceding embodiments.

The tapered configuration of the control portion 45 is formed at the area where S varies from 2 to 0, so that the resistance to motion of the piston increases due to such tapered configuration to thereby absorb the increased attractive force of the hatched portion in FIG. 7 when the piston moves through such range.

The tapered configuration of the control portion 45 may be formed such that the inner diameter of the cylinder 8 decreases gradually throughout the entire surface thereof without being limited to a specified range of the stroke S. Also, there may be provided a plunger type solenoid designed to include both the spring shown in FIG. 6 and the control portion shown in FIG. 8.

According to the present invention, the following effects can be achieved:

1. The speed of the plunger slows down such that the motion thereof is finished in 1–2 sec., rather than 0.02–0.04 sec.
2. The suddenly increasing attractive force of the plunger is easily eliminated.
3. The fine adjustment of the speed of the plunger is freely controlled.
4. The returning motion of the piston is easily and rapidly performed.
5. Energy losses are efficiently eliminated due to a decrease of friction resistance.
6. The leakage of oil is negligible.
7. The durability of the system is improved.
8. The manufacturing cost of the system is reduced.
9. Noise pollution is avoided.

Although the present invention has been described with reference to preferred embodiments thereof, many modifications and alterations may be made without departing from scope of the present invention.

What I claim is:

1. A plunger-type solenoid comprising:

a solenoid coil;

a plunger movably positioned within said solenoid coil, said plunger being movable in a first direction toward a first end of said solenoid upon energization of said solenoid coil, and said plunger being movable in a second direction opposite said first direction toward a second end of said solenoid coil upon deenergization of said solenoid coil;

a cylinder fixedly positioned with respect to said solenoid coil adjacent said first end thereof, said cylinder having therein a chamber containing a damping liquid;

a shaft having a first end connected to said plunger and a second end;

a piston fixedly connected to said second end of said shaft, such that said piston moves within said chamber during movement of said plunger in said first and second directions;

said piston having an outer peripheral edge which is separated from the internal surface of said chamber, thus forming an annular space therebetween, such that during movement of said piston within said chamber liquid is forced through said space in quantities inversely proportional to the degree of resistance to movement of said piston and plunger in said first and second directions; and said piston comprising a first substantially planar disc-shaped element formed of a rigid and inflexible material, said first disc-shaped element having a first diameter, and a second substantially planar disc-shaped element formed of a flexible material in abutting contact with said first disc-shaped element, said second disc-shaped element having a second diameter greater than said first diameter, and said first disc-shaped element being positioned closer to said plunger than is said second disc-shaped element, such that upon movement of said plunger in said first direction, said second disc-shaped element is maintained in substantially planar configuration in abutment with said first disc-shaped element, and said space is defined by said second diameter, and such that upon movement of said plunger in said second direction, said second disc-shaped element is deformed by said liquid in a manner such that said annular space is enlarged and is defined by said first diameter, thereby allowing an increased flow of said liquid through said annular space and reducing the resistance to movement of said piston and said plunger in said second direction.

2. A solenoid as claimed in claim 1, wherein said first disc-shaped element is formed of a metal material.

3. A solenoid as claimed in claim 1, wherein said second disc-shaped element is formed of a plastic material.

4. A solenoid as claimed in claim 1, wherein said second disc-shaped element is formed of a rubber material.

5. A solenoid as claimed in claim 1, wherein each of said first and second disc-shaped elements have apertures therethrough, and said first and second disc-shaped elements are attached to said shaft so as to be selectively circumferentially displaced relative to each other, such that said apertures of said first and second disc-shaped elements may be aligned in varying degrees, thereby providing means for adjusting the degree of resistance to movement of said piston and plunger.

6. A solenoid as claimed in claim 1, wherein said piston is fixedly connected to said second end of said shaft by a lever having a first end attached to said second end of said shaft and a second end attached to said piston, said lever being pivotable about a fixed point between said first and second ends.

7. A solenoid as claimed in claim 1, wherein said second end of said shaft extends into the interior of said chamber, and said first and second disc-shaped elements are directly attached to said shaft adjacent said second end thereof.

8. A solenoid as claimed in claim 7, further comprising a by-pass passage through said cylinder, said passage having opposite ends opening into the interior of said chamber on opposite sides of said piston, and adjusting valve means extending through said cylinder into said passage for adjusting the effective size of said passage.

9. A solenoid as claimed in claim 7, further comprising an auxiliary chamber within said cylinder at a position thereof furthest spaced from said plunger, said auxiliary chamber being in permanent adjoining communication with said chamber.

10. A solenoid as claimed in claim 7, further comprising spring means, surrounding said shaft at a position between said plunger and said cylinder, for retarding an increased speed of movement of said plunger during a latter portion of the movement of said plunger in said first direction, said spring means comprising a coil spring having a first end adjacent said plunger and a second end adjacent said cylinder, said first end being fixed, said second end being spaced from said cylinder at the beginning of movement of said plunger in said first direction, and said second end being brought into compressive contact with said cylinder prior to completion of movement of said plunger in said first direction.

11. A solenoid as claimed in claim 7, wherein the cross-sectional area of said chamber tapers inwardly.

* * * * *